US008872709B2

(12) United States Patent
Ogawa

(10) Patent No.: US 8,872,709 B2
(45) Date of Patent: Oct. 28, 2014

(54) ICE AND SNOW ACCRETION-PREVENTIVE ANTENNA, ELECTRIC WIRE, AND INSULATOR HAVING WATER-REPELLENT, OIL-REPELLENT, AND ANTIFOULING SURFACE AND METHOD FOR MANUFACTURING THE SAME

(75) Inventor: Kazufumi Ogawa, Awa (JP)

(73) Assignee: Empire Technology Development LLC, Wilmington, DE (US)

( * ) Notice: Subject to any disclaimer, the term of this patent is extended or adjusted under 35 U.S.C. 154(b) by 1302 days.

(21) Appl. No.: 12/600,144

(22) PCT Filed: May 13, 2008

(86) PCT No.: PCT/JP2008/058780

§ 371 (c)(1),
(2), (4) Date: Nov. 13, 2009

(87) PCT Pub. No.: WO2008/143065

PCT Pub. Date: Nov. 27, 2008

(65) Prior Publication Data

US 2010/0220018 A1 Sep. 2, 2010

(30) Foreign Application Priority Data

May 14, 2007 (JP) ..... 2007-127572

(51) Int. Cl.
*H01Q 1/02* (2006.01)
*B05D 5/08* (2006.01)

(52) U.S. Cl.
CPC . *H01Q 1/02* (2013.01); *B05D 5/083* (2013.01)
USPC ..... 343/704; 427/399; 427/290

(58) Field of Classification Search
CPC ..... B05D 5/08; B05D 5/083; B05D 5/086; B05D 3/06; H01Q 1/02
USPC ..... 343/704
See application file for complete search history.

(56) References Cited

U.S. PATENT DOCUMENTS 4,210,687 A 7/1980 Obendorf et al.
5,324,566 A 6/1994 Ogawa et al.

(Continued)

FOREIGN PATENT DOCUMENTS

EP 1479738 A1 * 11/2004 ..... C07D 7/12
EP 1640419 A1 * 3/2006

(Continued)

OTHER PUBLICATIONS

Yavuz Yuce, M., A. Levent Demirel and Frank Menzel. Tuning the Surface Hydrophobicity of Polymer/Nanoparticle Composite Films in the Wenzel Regime by Componsition, American Chemical Society, Apr. 21, 2005.*

(Continued)

*Primary Examiner* — Dameon E Levi
*Assistant Examiner* — Jennifer F Hu
(74) *Attorney, Agent, or Firm* — Foley & Lardner LLP

(57) ABSTRACT

A representative embodiment prevents breakage of antennas and accidents due to breakage of electric wires caused by ice and snow accretion by realizing a surface with a surface energy of 2 mN/m or less and providing an antenna and electric wire having an extremely great effect of preventing ice and snow accretion at midwinter.
Another representative embodiment provides an ice and snow accretion-preventive antenna and electric wire wherein a surface thereof is compositely fabricated to have large roughness and small roughness, and the surface of each of the roughness is coated with a water-repellent, oil-repellent, and antifouling thin film.

9 Claims, 3 Drawing Sheets

(56) References Cited

U.S. PATENT DOCUMENTS

| | | | | |
|---|---|---|---|---|
| 5,437,894 | A | 8/1995 | Ogawa et al. | |
| 6,337,129 | B1 | 1/2002 | Watanabe et al. | |
| 7,635,522 | B2 | 12/2009 | Cnossen et al. | |
| 7,959,826 | B2 * | 6/2011 | Gallagher et al. | 252/70 |
| 7,985,475 | B2 * | 7/2011 | Dubrow | 428/359 |
| 2001/0005531 | A1 * | 6/2001 | Ogawa | 427/399 |
| 2001/0051273 | A1 * | 12/2001 | Veerasamy | 428/408 |
| 2002/0045010 | A1 * | 4/2002 | Rohrbaugh et al. | 427/372.2 |
| 2002/0192385 | A1 * | 12/2002 | Jenkner et al. | 427/387 |
| 2005/0136180 | A1 * | 6/2005 | Pellerite et al. | 427/162 |
| 2006/0154048 | A1 * | 7/2006 | Teranishi et al. | 428/323 |
| 2010/0119774 | A1 | 5/2010 | Ogawa | |
| 2010/0167067 | A1 * | 7/2010 | Hung | 428/448 |
| 2010/0212736 | A1 | 8/2010 | Ogawa | |
| 2010/0330373 | A1 | 12/2010 | Ogawa | |
| 2012/0027995 | A1 | 2/2012 | Hung | |

FOREIGN PATENT DOCUMENTS

| | | | | |
|---|---|---|---|---|
| JP | 2258032 | | 10/1990 | |
| JP | 08-195126 | | 7/1996 | |
| JP | 11-171592 | | 6/1999 | |
| JP | 2006-067834 | | 3/2006 | |
| JP | 2006-181486 | | 7/2006 | |
| WO | WO 9842452 | A1 * | 10/1998 | B05D 3/06 |
| WO | WO 0114497 | A1 * | 3/2001 | |
| WO | WO-2004/052640 | A1 | 6/2004 | |
| WO | WO 2004090065 | A1 * | 10/2004 | C09K 3/18 |
| WO | WO 2005021843 | A1 * | 3/2005 | D01D 5/00 |
| WO | WO 2005068400 | A1 * | 7/2005 | C04B 41/45 |

OTHER PUBLICATIONS

International Search Report issued in PCT/JP2008/058780 mailed Aug. 19, 2008 (and English translation).

International Preliminary Report on Patentability for PCT/JP2008/058780 mailed Jan. 21, 2010 (English translation).

"Self-assembled monolayer," Wikipedia, accessed on Mar. 1, 2012 at http://en.wikipedia.org/wiki/Self-assembled_monolayer, 10 pp.

International Preliminary Report on Patentability for Intl. Pat. Appln. No. PCT/JP2008/058783, mailed on Jan. 21, 2010 (English translation included), 13 pp.

International Search Report for Intl. Pat. Appln. No. PCT/JP2008/058783, mailed on Aug. 19, 2008, 1 p.

Leslie, Y., "Wettability Patterning," accessed at http://users.monash.edu.au/~lyeo/Dr_Leslie_Yeo/Publications_files/Wetting%26Spreading_Encyclopedia%20of%20Microfluidics%20and%20Nanofluidics.pdf, 11 pp.

Non-Final Office Action in U.S. Appl. No. 12/600,140 dtd Aug. 9, 2013.

Final Office Action in U.S. Appl. No. 12/600,140 dtd Feb. 18, 2014 (8 pages).

* cited by examiner (A)

(B)

HERE,

REPRESENTS $F_3C(CF_2)_7(CH_2)_2Si(-O-)_2-O-$

ICE AND SNOW ACCRETION-PREVENTIVE ANTENNA, ELECTRIC WIRE, AND INSULATOR HAVING WATER-REPELLENT, OIL-REPELLENT, AND ANTIFOULING SURFACE AND METHOD FOR MANUFACTURING THE SAME

CROSS-REFERENCE TO RELATED APPLICATIONS

The present application is a U.S. national stage application claiming the benefit of International Application No. PCT/JP2008/0587380, filed on May 13, 2008, which claims the benefit of Japanese Application No. 2007-127572, filed on May 14, 2007, the entire contents of which are incorporated herein by reference in their entireties.

TECHNICAL FIELD

The present invention relates to an ice and snow accretion-preventive antenna, electric wire, and insulator having a very low surface energy to such an extent that the surface thereof repels silicone oil. In addition, the present invention relates to a method for manufacturing an ice and snow accretion-preventive antenna, electric wire, and insulator.

BACKGROUND ART

In general, it is known that a surface which has roughness with a size of about 10 micrometers and in which the surfaces of the roughness are coated with a coating film made of a fatty acid exhibits ultra water-repellency, such that a water-repellency angle for a water droplet of about 140 degrees is achieved, as observed with a lotus leaf. The present invention is made by imitating and improving upon this principle.

DISCLOSURE OF INVENTION

Problem to be Solved by the Invention

Nowadays, antennas, electric wires, and insulators serving as lifelines are essential equipment for maintaining life in heavy snowfall areas. However, under the present situation, at midwinter, breakage of antennas and insulators and accidents due to breakage of electric wires caused by ice and snow accretion constantly occur. Consequently, some antennas and the like are coated with a fluorine coating material to prevent ice and snow accretion. However, the surface energy of a fluorocarbon resin is at least about 15 mN/m, which is not sufficient in terms of an effect for ice and snow accretion.

In view of the above-described present situation, it is an object of the present invention to prevent breakage of antennas and insulators and accidents due to breakage of electric wires caused by ice and snow accretion by realizing a surface with a surface energy of 2 mN/m or less and providing an antenna, electric wire, and insulator having an extremely great effect of preventing ice and snow accretion at midwinter.

In the case where the above physical property value can be realized, the technique can be used for, for example, preventing ice and snow accretion on various types of weather observation instruments such as rain gauges, preventing ice accretion on a dispensing portion of a liquid nitrogen tank or a liquid oxygen tank, and preventing ice accretion on an external fuel tank of a space shuttle. Accordingly, a significant effect of preventing accidents caused by ice accretion can be achieved.

Means for Solving the Problems

A first invention provided as means for solving the above problem is an ice and snow accretion-preventive antenna, electric wire, and insulator wherein a surface thereof is compositely fabricated to have large roughness and small roughness, and the surface of each of the roughness is coated with a water-repellent, oil-repellent, and antifouling thin film.

A second invention is the ice and snow accretion-preventive antenna, electric wire, and insulator according to the first invention, wherein the large roughness has a size in the range of 500 to 10 μm, and the small roughness has a size of less than 10 μm and 10 nm or more.

A third invention is the ice and snow accretion-preventive antenna, electric wire, and insulator according to the first invention, wherein the area of a convex portion of the large roughness is smaller than the area of a concave portion thereof, and the interval between convex portions of the small roughness is smaller than the depth of a concave portion thereof.

A fourth invention is the ice and snow accretion-preventive antenna, electric wire, and insulator according to any one of the first to third inventions, wherein the water-repellent, oil-repellent, and antifouling thin film is covalently bonded to the surfaces of the roughness of both types.

A fifth invention is the ice and snow accretion-preventive antenna, electric wire, and insulator according to the fourth invention, wherein the water-repellent, oil-repellent, and antifouling thin film contains a —$CF_3$ group.

A sixth invention is the ice and snow accretion-preventive antenna, electric wire, and insulator according to any one of the first to fifth inventions, wherein the water-repellent, oil-repellent, and antifouling thin film is a monomolecular film.

A seventh invention is the ice and snow accretion-preventive antenna, electric wire, and insulator according to any one of the first to sixth inventions, wherein a critical surface energy of the surface is 2 mN/m or less.

An eighth invention is a method for manufacturing an ice and snow accretion-preventive antenna, electric wire, and insulator including at least the steps of processing a surface by blasting or dimpling, performing chemical etching or electrolytic etching, and forming a water-repellent, oil-repellent, and antifouling thin film.

A ninth invention is the method for manufacturing an ice and snow accretion-preventive antenna, electric wire, and insulator according to the eighth invention, wherein the step of forming the water-repellent, oil-repellent, and antifouling thin film includes a step of forming the water-repellent, oil-repellent, and antifouling coating film using a reaction solution prepared by mixing an alkoxysilane compound having a fluorocarbon group and an alkoxysilyl group, a silanol condensation catalyst, and a nonaqueous organic solvent, a reaction solution prepared by mixing a chlorosilane compound having a fluorocarbon group and a trichlorosilyl group with a nonaqueous organic solvent, or a reaction solution prepared by mixing an isocyanate compound having a fluorocarbon group and an isocyanate group with a nonaqueous organic solvent.

A tenth invention is the method for manufacturing an ice and snow accretion-preventive antenna, electric wire, and insulator according to the eighth or ninth invention, wherein the step of forming the water-repellent, oil-repellent, and antifouling thin film includes a step of removing excess reaction solution by washing, the step being performed after contact.

An eleventh invention is the method for manufacturing an ice and snow accretion-preventive antenna, electric wire, and insulator according to the ninth or tenth invention, wherein at least one selected from ketimine compounds, organic acids, metal oxides, aldimine compounds, enamine compounds, oxazolidine compounds, and aminoalkylalkoxysilane compounds as a cocatalyst is used to be mixed with the silanol condensation catalyst.

More specifically, the present invention provides an ice and snow accretion-preventive antenna, electric wire, and insulator wherein a surface thereof is compositely fabricated to have large roughness and small roughness and the surface of each of the roughness is coated with a water-repellent, oil-repellent, and antifouling thin film, the ice and snow accretion-preventive antenna, electric wire, and insulator being produced by at least a step of processing the surface by blasting or dimpling, performing chemical etching or electrolytic etching, and forming the water-repellent, oil-repellent, and antifouling thin film.

Here, the large roughness preferably have a size in the range of 500 to 10 μm, and the small roughness preferably have a size of less than 10 μm and 10 nm or more. This is advantageous in that the critical surface energy can be made to be 2 mN/m or less.

In addition, the area of a convex portion of the large roughness is preferably smaller than the area of a concave portion thereof, and the interval between convex portions of the small roughness is preferably smaller than the depth of a concave portion thereof. This is advantageous in that the critical surface energy can be made to be 2 mN/m or less.

In addition, preferably, the water-repellent, oil-repellent, and antifouling thin film is covalently bonded to the surfaces of the roughness of both types. This is advantageous in that the durability of water-repellent, oil-repellent, and antifouling performance is improved.

Furthermore, the water-repellent, oil-repellent, and antifouling thin film preferably contains a —$CF_3$ group. This is advantageous in that the critical surface energy can be made to be 2 mN/m or less.

In addition, the water-repellent, oil-repellent, and antifouling thin film is preferably a monomolecular film. This is advantageous in that the critical surface energy can be made to be 2 mN/m or less.

In addition, in this case, the step of forming a water-repellent, oil-repellent, and antifouling thin film preferably includes a step of forming the water-repellent, oil-repellent, and antifouling coating film using a reaction solution prepared by mixing an alkoxysilane compound having a fluorocarbon group and an alkoxysilyl group, a silanol condensation catalyst, and a nonaqueous organic solvent, a reaction solution prepared by mixing a chlorosilane compound having a fluorocarbon group and a trichlorosilyl group with a nonaqueous organic solvent, or a reaction solution prepared by mixing an isocyanate compound having a fluorocarbon group and an isocyanate group with a nonaqueous organic solvent. This is advantageous in that the manufacturing time of the ice and snow accretion-preventive antenna, electric wire, and insulator can be reduced.

In addition, the step of forming a water-repellent, oil-repellent, and antifouling thin film preferably includes a step of removing excess reaction solution by washing, the step being performed after contact. This is advantageous in that the roughness of the base material is not impaired at all.

Furthermore, at least one selected from ketimine compounds, organic acids, metal oxides, aldimine compounds, enamine compounds, oxazolidine compounds, and aminoalkylalkoxysilane compounds as a cocatalyst is preferably used to be mixed with a silanol condensation catalyst. This is advantageous in that the manufacturing time of the ice and snow accretion-preventive antenna, electric wire, and insulator can be reduced.

Advantages

By providing an antenna, electric wire, and insulator having an extremely high effect of preventing ice and snow accretion at midwinter, breakage of antennas and accidents due to breakage of electric wires and insulators caused by ice and snow accretion can be advantageously prevented.

BEST MODE FOR CARRYING OUT THE INVENTION

The present invention provides an ice and snow accretion-preventive antenna, electric wire, and insulator wherein a surface thereof is compositely fabricated to have large roughness and small roughness and the surface of each of the roughness is coated with a water-repellent, oil-repellent, and antifouling thin film, the antenna, electric wire, and insulator being manufactured by at least a step of processing the surface by blasting or dimpling, performing chemical etching or electrolytic etching, and forming the water-repellent, oil-repellent, and antifouling thin film.

Accordingly, the present invention has a function for realizing a surface for which the angle of contact for a water droplet is 150 degrees or more, and for which the angle of contact for even a droplet of a silicone oil having a surface energy of about 20 mN/m is about 120 degrees.

Details of the present invention will now be described using Examples, but the present invention is not limited to the Examples. In addition to an antenna, an electric wire, and an insulator, the present invention can be used for, for example, preventing ice and snow accretion on various types of weather observation instruments such as rain gauges, preventing ice accretion on a dispensing portion of a liquid nitrogen tank or a liquid oxygen tank, and preventing ice accretion on an external fuel tank of a space shuttle.

Any material can be used as the ice and snow accretion-preventive antenna and electric wire related to the present invention as long as the material is a metal that can undergo electrolytic etching (e.g., aluminum and alloys thereof, copper and alloys thereof, and iron and alloys thereof). A description will now be made using, as a typical example, a parabolic antenna made of an aluminum alloy. On the other hand, for a ceramic product such as an insulator, a surface of the ceramic product is processed by blasting to form roughness, and a water-repellent treatment can then be performed in the same manner.

Example 1

A chemical agent having a fluorocarbon group ($-CF_3$) at one end thereof and an alkoxysilyl group at another end thereof, for example, 99 weight percent of a chemical agent represented by $CF_3(CF_2)_7(CH_2)_2Si(OCH_3)_3$ and 1 weight percent of a silanol condensation catalyst, for example, dibutyltin diacetylacetonate were weighed. The chemical agent and the silanol condensation catalyst were dissolved in a silicone solvent, for example, a hexamethyldisiloxane solvent in a concentration of about 1 weight percent (a preferable concentration of a chemisorption agent was in the range of about 0.5% to 3%) to prepare a reaction solution.

Figure 1:
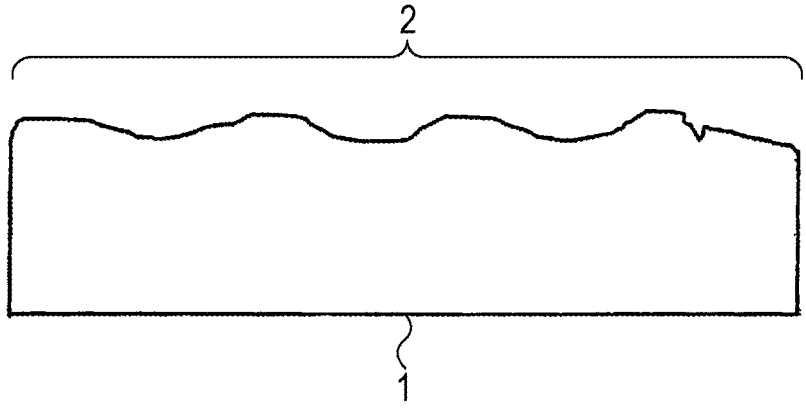
FIG. 1 is a schematic cross-sectional view showing a state in which large roughness 2 having a roughness in the range of 100 to 200 μm are formed on a surface of aluminum in Example 1 of the present invention.

On the other hand, an aluminum plate 1 used as a concave portion of a parabolic antenna and having a thickness of about 2 mm was prepared and sufficiently washed. A blasting process was then performed over the entire surface of the aluminum plate 1 using an emery powder of #30 to form large roughness 2 having a roughness in the range of 100 to 200 μm (FIG. 1).

Figure 2:
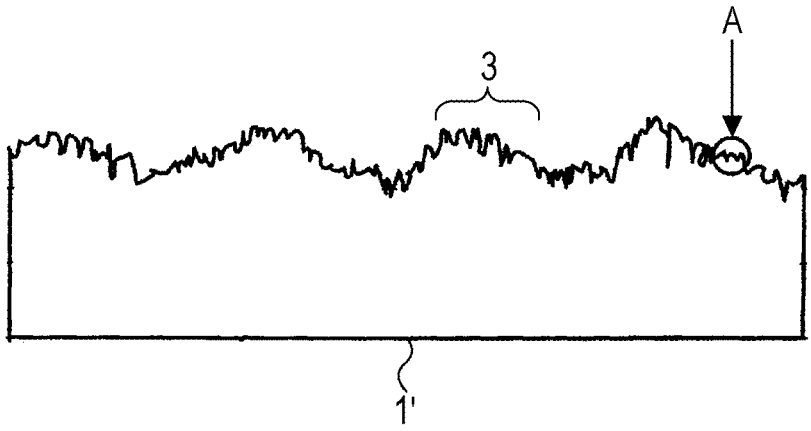
FIG. 2 is a schematic cross-sectional view showing a state in which the large roughness 2 having a roughness in the range of 100 to 200 μm are formed on the surface of aluminum, and small roughness 2 having a roughness in the range of 2 to 0.5 μm are then compositely formed by further etching the surface with a phosphoric acid etchant in Example 1 of the present invention.

Furthermore, the surface was etched using a phosphoric acid etchant to form small roughness 3 having a roughness in the range of 2 to 0.5 μm (FIG. 2).

Figure 3:
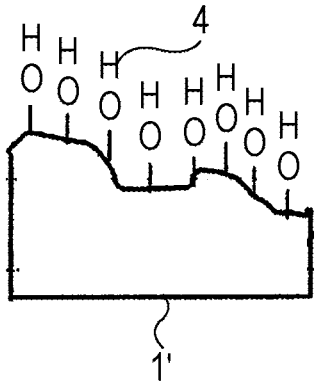
FIG. 3 includes schematic cross-sectional views in which portion A surrounded by the circle in FIG. 2 is enlarged to the molecular level. (A) is a schematic cross-sectional view of the portion near the surface before a monomolecular film is formed, and (B) is a schematic cross-sectional view of the portion near the surface after the monomolecular film is formed.
Figure 3:
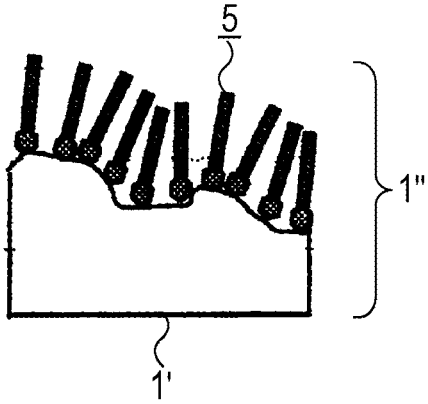
Figure 3:
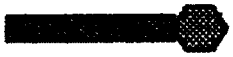

Subsequently, the above aluminum plate 1' whose surface was compositely fabricated to have large roughness and small roughness was immersed in the reaction solution, and a reaction was performed for about one hour under stirring in air (relative humidity of 45%). A large number of hydroxyl groups 4 were contained on the surface the aluminum plate 1' (FIG. 3(A)). Accordingly, in this step, a —$Si(OCH_3)$ group of the chemisorption agent and the hydroxyl group 2 were subjected to a dealcoholization reaction (demethanol ($deCH_3OH$) in this case) in the presence of the silanol condensation catalyst. Consequently, a chemisorbed monomolecular film 5 containing a fluorocarbon group represented by formula (Chemical Formula 1) below was formed over the entire surface of the aluminum plate 1' by being chemically bonded to the surface to have a thickness of about 1 nm (FIG. 3(B)).

Figure 4:
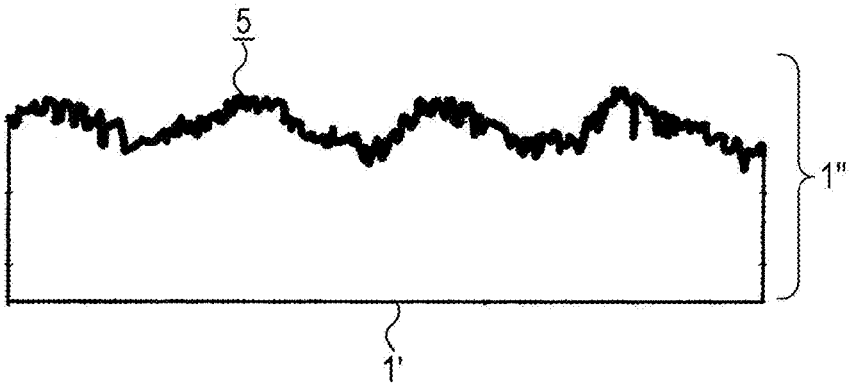
FIG. 4 is a schematic cross-sectional view showing a state in which, after the roughening treatment, a water-repellent, oil-repellent, and antifouling monomolecular film is formed on the surface.

Subsequently, excess unreacted adsorption solution was removed by washing with a chlorinated solvent such as chloroform. Accordingly, an aluminum plate 1" whose surface was compositely fabricated to have large roughness and small roughness, in which the surface of each of the roughness was coated with the water-repellent, oil-repellent, and antifouling monomolecular film 5, and which had excellent water-repellent and oil-repellent properties could be manufactured (FIG. 4).

Here, even when the step of removing excess unreacted adsorption solution by washing was omitted, and the aluminum plate was taken out from the solution without further treatment to vaporize the unreacted adsorption solution, an aluminum plate which had excellent water-repellent and oil-repellent properties and in which no problems occurred at a practical level could be produced, though the performance was somewhat degraded and a monomolecular film could not be obtained.

[Chemical formula 1]

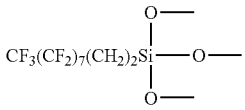

Here, the same experiment was repeated while the condition for the surface roughening was varied. According to the results, it was found that when the large roughness had a size in the range of 500 to 10 μm and the small roughness had a size of less than 10 μm and 10 nm or more, a critical surface energy could be made to be 2 mN/m or less.

In addition, the surface roughness in this case was examined. According to the results, it was found that the area of a convex portion of the large roughness was smaller than the area of a concave portion thereof, and the interval between convex portions of the small roughness was smaller than the depth of a concave portion thereof.

Furthermore, when electrolytic etching was performed instead of chemical etching, the performance could be further improved, and 1 mN/m or less could be easily realized.

Figure 5:
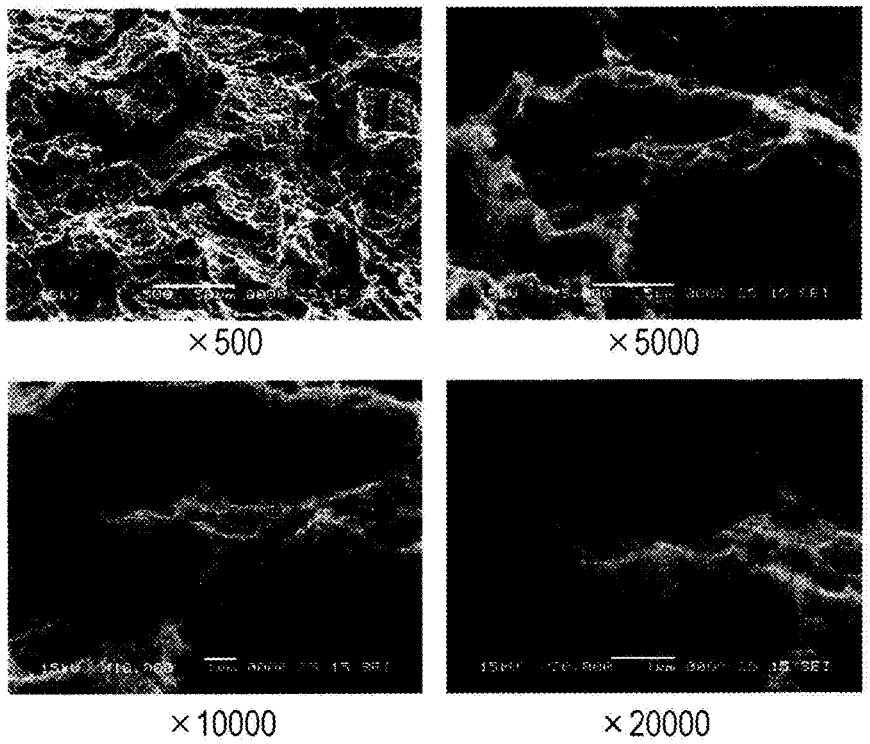
FIG. 5 includes SEM images of a surface of an ice and snow accretion-preventive antenna as a trial product whose surface is compositely fabricated to have large roughness and small roughness and is coated with a water-repellent, oil-repellent, and antifouling thin film. Note that the scale bar of ×500 represents 50 μm, the scale bar of ×5,000 represents 5 μm, the scale bar of ×10,000 represents 1 μm, and the scale bar of ×20,000 represents 1 μm.
Figure 6:
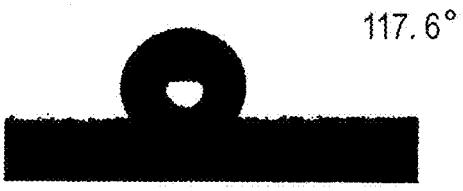
FIG. 6 is a cross-sectional photograph of a droplet when a silicone oil is dripped on the surface of the ice and snow accretion-preventive antenna shown in FIG. 5.

In particular, when the surface roughness was the values shown in Table 1, an apparent critical surface energy was 1 or less. In this case, the angle of contact for a liquid droplet could be controlled to be 117.6 degrees even when a silicone oil having a surface energy of 19.7 mN/m was used. FIG. 5 shows SEM observation images of the surface of a substrate under this condition. In addition, FIG. 6 shows a cross-sectional photograph showing an oil-repellent state of a droplet of the silicone oil (having a surface energy of 19.7 mN/m).

TABLE 1

| Measurement results of the roughness (μm) | | | |
|---|---|---|---|
| Roughness | Maximum height | Average height | Interval |
| 9.09 | 51.5 | 34.5 | 139 |

In Example 1, $CF_3(CF_2)_7(CH_2)_2Si(OCH_3)_3$ which is a fluorocarbon chemisorption agent was used as a chemical agent for forming the oil-repellent monomolecular film. In addition to the above chemical agent, substances represented by (1) to (12) below could also be used.

(1) $CF_3CH_2O(CH_2)_{15}Si(OCH_3)_3$
(2) $CF_3(CH_2)_3Si(CH_3)_2(CH_2)_{15}Si(OCH_3)_3$
(3) $CF_3(CF_2)_5(CH_2)_2Si(CH_3)_2(CH_2)_9Si(OCH_3)_3$
(4) $CF_3(CF_2)_7(CH_2)_2Si(CH_3)_2(CH_2)_9Si(OCH_3)_3$
(5) $CF_3COO(CH_2)_{15}Si(OCH_3)_3$
(6) $CF_3(CF_2)_5(CH_2)_2Si(OCH_3)_3$
(7) $CF_3CH_2O(CH_2)_{15}Si(OC_2H_5)_3$
(8) $CF_3(CH_2)_3Si(CH_3)_2(CH_2)_{15}Si(OC_2H_5)_3$ (9) $CF_3(CF_2)_5(CH_2)_2Si(CH_3)_2(CH_2)_9Si(OC_2H_5)_3$
(10) $CF_3(CF_2)_7(CH_2)_2Si(CH_3)_2(CH_2)_9Si(OC_2H_5)_3$
(11) $CF_3COO(CH_2)_{15}Si(OC_2H_5)_3$
(12) $CF_3(CF_2)_5(CH_2)_2Si(OC_2H_5)_3$

Here, when the base material was made of gold, a thiol-terminated or triazinethiol-terminated chemical agent, for example, $CF_3(CF_2)_7(CH_2)_2SH$ could be used. In this case, an SH group was bonded to gold, thus producing a similar water-repellent and oil-repellent film.

Furthermore, in Examples 1 and 2, as the silanol condensation catalyst, carboxylic acid metal salts, carboxylate metal salts, carboxylic acid metal salt polymers, carboxylic acid metal salt chelates, titanates, and titanate chelates can be used. More specifically, stannous acetate, dibutyltin dilaurate, dibutyltin dioctoate, dibutyltin diacetate, dioctyltin dilaurate, dioctyltin dioctoate, dioctyltin diacetate, stannous dioctoate, lead naphthenate, cobalt naphthenate, iron 2-ethylhexenoate, dioctyltin bisoctyl thioglycolate, dioctyltin maleate, dibutyltin maleate polymers, dimethyltin mercaptopropionate polymers, dibutyltin bisacetylacetate, dioctyltin bisacetyllaurate, tetrabutyl titanate, tetranonyl titanate, and bis(acetylacetonyl)dipropyl titanate could be used.

In Example 1, in the case where a silanol condensation catalyst was not used, substances represented by (41) to (52) below could be used.

(41) $CF_3CH_2O(CH_2)_{15}SiCl_3$
(42) $CF_3(CH_2)_3Si(CH_3)_2(CH_2)_{15}SiCl_3$
(43) $CF_3(CF_2)_5(CH_2)_2Si(CH_3)_2(CH_2)_9SiCl_3$
(44) $CF_3(CF_2)_7(CH_2)_2Si(CH_3)_2(CH_2)_9SiCl_3$
(45) $CF_3COO(CH_2)_{15}SiCl_3$
(46) $CF_3(CF_2)_5(CH_2)_2Si(NCO)_3$
(47) $CF_3CH_2O(CH_2)_{15}Si(NCO)_3$
(48) $CF_3(CH_2)_3Si(CH_3)_2\ (CH_2)_{15}Si(NCO)_3$
(49) $CF_3(CF_2)_5(CH_2)_2Si(CH_3)_2(CH_2)_9Si(NCO)_3$
(50) $CF_3(CF_2)_7(CH_2)_2Si(CH_3)_2(CH_2)_9Si(NCO)_3$
(51) $CF_3COO(CH_2)_{15}Si(NCO)_3$
(52) $CF_3(CF_2)_5(CH_2)_2Si(NCO)_3$

Furthermore, as the solvent of the reaction solution for forming a film, in both the case where the chemisorption agent was an alkoxysilane compound and the case where the chemisorption agent was a chlorosilane compound, organochlorine solvents, hydrocarbon solvents, fluorocarbon solvents, and silicone solvents, all of which did not contain water, and mixtures thereof could be used. When the particle concentration was increased by evaporating the solvent without performing washing, the boiling point of the solvent was preferably in the range of about 50° C. to 250° C.

In the case of a chlorosilane compound, specific examples of the solvents that can be used include nonaqueous petroleum naphtha, solvent naphtha, petroleum ether, petroleum benzine, isoparaffin, normal paraffin, decalin, industrial gasoline, nonanes, decanes, kerosene, dimethyl silicone, phenyl silicone, alkyl-modified silicone, polyether silicone, and dimethylformamide.

Furthermore, when the adsorbent was an alkoxysilane compound and an organic coating film was formed by evaporating a solvent, in addition to the above solvents, alcohol solvents such as methanol, ethanol, and propanols, and mixtures thereof could be used.

Examples of the fluorocarbon solvents include chlorofluorocarbon solvents, Fluorinert (a product available from 3M), and Aflude (a product available from Asahi Glass Co., Ltd.). These may be used alone or in combination of two or more solvents that can be sufficiently mixed with each other. Furthermore, an organochlorine solvent such as chloroform may be added to the solvent.

On the other hand, instead of the above-described silanol condensation catalyst, when a ketimine compound, an organic acid, a metal oxide such as $TiO_2$, an aldimine compound, an enamine compound, an oxazolidine compound, or an aminoalkylalkoxysilane compound was used at the same concentration, the processing time could be reduced to about ½ to ⅔.

Furthermore, when the silanol condensation catalyst was mixed with a ketimine compound, an organic acid, a metal oxide such as $TiO_2$, an aldimine compound, an enamine compound, an oxazolidine compound, or an aminoalkylalkoxysilane compound (these compounds could be used at a mixing ratio in the range of 1:9 to 9:1, but a ratio of about 1:1 was generally preferable) for use, the processing time could be further reduced several-folds, and thus, the film formation time could be reduced to a fraction of the film formation time when these compounds are not used.

For example, when dibutyltin oxide which is a silanol catalyst was replaced with H3, which is a ketimine compound manufactured by Japan Epoxy Resins Co., Ltd., and other conditions were the same, substantially the same results were obtained except that the reaction time could be reduced to about one hour.

Furthermore, when the silanol catalyst was replaced with a mixture (mixing ratio: 1:1) of H3, which is a ketimine compound manufactured by Japan Epoxy Resins Co., Ltd., and dibutyltin bisacetylacetonate which is a silanol catalyst and other conditions were the same, substantially the same results were obtained except that the reaction time could be reduced to about 20 minutes.

Accordingly, these results showed that the activities of ketimine compounds, organic acids, aldimine compounds, enamine compounds, oxazolidine compounds, and aminoalkylalkoxysilane compounds were higher than the activities of the silanol condensation catalyst.

Furthermore, it was confirmed that when one of ketimine compounds, organic acids, aldimine compounds, enamine compounds, oxazolidine compounds, and aminoalkylalkoxysilane compounds was mixed with the silanol condensation catalyst for use, the activity was further increased.

Examples of the ketimine compounds that can be used here include, but are not particularly limited to, 2,5,8-triaza-1,8-nonadiene, 3,11-dimethyl-4,7,10-triaza-3,10-tridecadiene, 2,10-dimethyl-3,6,9-triaza-2,9-undecadiene, 2,4,12,14-tetramethyl-5,8,11-triaza-4,11-pentadecadiene, 2,4,15,17-tetramethyl-5,8,11,14-tetraaza-4,14-octadecadiene, and 2,4,20,22-tetramethyl-5,12,19-triaza-4,19-trieicosadiene.

Examples of the organic acids that can be used include, but are also not particularly limited to, formic acid, acetic acid, propionic acid, butyric acid, and malonic acid. These organic acids achieved substantially the same effects.

REFERENCE NUMERALS

1 aluminum plate
1' aluminum plate whose surface is compositely fabricated to have large roughness and small roughness
1" aluminum plate whose surface is compositely fabricated to have large roughness and small roughness and on which a water-repellent, oil-repellent, and antifouling monomolecular film is further provided
2 large roughness
3 small roughness
4 hydroxyl group
5 water-repellent, oil-repellent, and antifouling monomolecular film

The invention claimed is:

1. An ice and snow accretion-preventive assembly having an antenna, electric wire, and insulator, wherein a surface of a base material of at least a portion of the assembly is fabricated to have large roughness and small roughness by removal of a portion of the base material, and wherein the surface of each of the large roughness and the small roughness is coated with a water-repellent, oil-repellent, and antifouling thin film, wherein the large roughness has a size in the range of 500 to 10 μm, and the small roughness has a size of less than 10 μm, wherein a critical surface energy of the surface is at most 2 mN/m.

2. The ice and snow accretion-preventive assembly according to claim 1, wherein the area of a convex portion of the large roughness is smaller than the area of a concave portion thereof, and the interval between convex portions of the small roughness is smaller than the depth of a concave portion thereof.

3. The ice and snow accretion-preventive assembly according to claim 1, wherein the water-repellent, oil-repellent, and antifouling thin film is covalently bonded to the surface of the large roughness and the small roughness.

4. The ice and snow accretion-preventive assembly according to claim 3, wherein the water-repellent, oil-repellent, and antifouling thin film contains a —$CF_3$ group.

5. The ice and snow accretion-preventive assembly according to claim 1, wherein the water-repellent, oil-repellent, and antifouling thin film is a monomolecular film.

6. The ice and snow accretion-preventive assembly of claim 1, wherein the base material is a conducting material of the electric wire.

7. The ice and snow accretion-preventive assembly of claim 1, wherein the base material is an insulating material of the insulator.

8. The ice and snow accretion-preventive assembly of claim 1, wherein a critical surface energy of the surface is at most 1 mN/m.

9. An ice and snow accretion-preventive assembly having an antenna, electric wire, and insulator comprising:

a base material, wherein a surface of the base material is fabricated, by removal of a portion of the base material, to have target roughness having a size in the range of 500 to 10 μm and small roughness having a size of less than 10 μm, and a water-repellent, oil-repellent, and antifouling monomolecular film covering the large roughness and the small roughness and containing —CF3 group, wherein the area of a convex portion of the large roughness is smaller than the area of a concave portion of the large roughness, and the interval between convex portions of the small roughness is smaller than a depth of a concave portion of the large roughness, wherein a critical surface energy of the surface is at most 2 mN/m.

* * * * *

UNITED STATES PATENT AND TRADEMARK OFFICE

CERTIFICATE OF CORRECTION

PATENT NO. : 8,872,709 B2
APPLICATION NO. : 12/600144
DATED : October 28, 2014
INVENTOR(S) : Ogawa It is certified that error appears in the above-identified patent and that said Letters Patent is hereby corrected as shown below:

On the Title Page, in item (56), under "OTHER PUBLICATIONS", in Column 2, line 3, delete "Componsition," and insert -- Composition, --, therefor.

In the Claims

In Column 10, Line 20, in Claim 9, delete "-CF3" and insert -- a $-CF_3$ --, therefor.

Signed and Sealed this
Seventh Day of April, 2015

Michelle K. Lee

Michelle K. Lee
*Director of the United States Patent and Trademark Office*